United States Patent [19]

Creusen et al.

[11] Patent Number: 4,855,587

[45] Date of Patent: Aug. 8, 1989

[54] X-RAY IMAGE INTENSIFIER TUBE WITH CARBON-REINFORCED PLASTIC FOIL ENTRANCE WINDOW

[75] Inventors: Caspard H. J. Creusen; Johannes K. E. Colditz, both of Heerlen, Netherlands

[73] Assignee: U.S. Philips Corporation, New York, N.Y.

[21] Appl. No.: 190,199

[22] Filed: May 4, 1988

[30] Foreign Application Priority Data

May 22, 1987 [NL] Netherlands ..... 8701222

[51] Int. Cl.[4] ..... H01J 31/50; H01J 40/14

[52] U.S. Cl. ..... 250/213 VT; 313/525

[58] Field of Search ..... 250/213 VT, 213 R, 483.1, 250/486.1; 313/525, 526, 527, 542, 543, 544

[56] References Cited

U.S. PATENT DOCUMENTS 4,238,043 12/1980 Minami et al. ..... 313/527

4,331,898 5/1982 Shimizu et al. ..... 250/213 VT

OTHER PUBLICATIONS

"X,Y,B-Ray Detector Windows of Composite Material Replacing Beryllium in the 4.2–420K Temperature Range", Nuclear Istr. & Meth. in Phy. Res. (1986), Rimbert et al, pp. 95–99.

*Primary Examiner*—David C. Nelms

*Assistant Examiner*—Eric F. Chatmon

*Attorney, Agent, or Firm*—Robert J. Kraus

[57] ABSTRACT

An X-ray image intensifier tube comprises an entrance window which is composed of a carbon fibre reinforced plastics foil which is covered with a metal layer. The plastics foil has a comparatively low absorption and the metal layers can be constructed so as to be sufficiently thin and from suitable materials such that only a low absorption occurs therein. The metal layers ensure that the entrance window is suitably vacuumtight and allow for simple vacuum tight connection of the entrance window to the further envelope.

8 Claims, 1 Drawing Sheet

X-RAY IMAGE INTENSIFIER TUBE WITH CARBON-REINFORCED PLASTIC FOIL ENTRANCE WINDOW

The invention relates to an X-ray image intensifier tube, comprising an entrance window and an exit window which form part, together with a cylindrical jacket, of a vacuumtight envelope which accommodates an entrance screen with a luminescent layer and a photocathode, a photo-electron imaging electrode system, and an exit screen.

An X-ray image intensifier tube of this kind is known from U.S. Pat. No. 4,213,055. Known X-ray image intensifier tubes have the drawback that the X-ray absorption of the entrance window is comparatively high and that a comparatively large amount of scattering occurs therein. Radiation absorption in the entrance window leads to a higher load for a patient and the scattering therein causes deterioration of the image quality which implies a higher radiation load again for a patient to be examined if an image containing adequate diagnostic information is still to be obtained.

In order to prevent scattering, an entrance window will preferably be constructed to be comparatively thin; however, this may not be at the expense of adequate strength for its function as a vacuum wall for the envelope. The absorption in a window can be comparatively low if the widow is comparatively thin and is made of a material having a comparatively low X-ray absorption for a given thickness. In practice this means that materials are used which have an as low as possible atomic number.

SUMMARY OF THE INVENTION

It is an object of the invention to satisfy the above requirements; to achieve this, an X-ray image intensifier tube of the kind set forth is characterized in that the entrance window comprises a carbon fibre reinforced plastics foil covered with a metal layer.

In an X-ray image intensifier tube comprising an entrance window having such a plastics foil the above drawbacks can be mitigated in that such a carbon foil has a very low X-ray absorption and is strong enough, and even in the case of a small thickness, to act as a vacuumtight window. When a foil of this kind is covered with a metal layer, it can be rendered suitably vacuumtight; the metal layer also forms a suitable intermediate layer for the vacuumtight bonding of the entrance window to the cylinder jacket of the X-ray image intensifier tube. By using elements having a low atomic number for the metal cover layer, high absorption can be prevented therein because the function of vacuumtightness can already be achieved by means of a comparatively thin metal layer. The drawback of the non-perfect vacuumtightness of the plastics foil is thus avoided by enclosing the foil in a vacuumtight envelope. Both sides of the window should be covered because otherwise either a unilateral metal coating should still act as a real vacuum wall because of gas diffusion or gases from the plastics could have an adverse effect on the interior of the X-ray image intensifier tube.

The metal layer in a preferred embodiment consists of an aluminium foil or aluminium which is deposited on the carbon foil, for example by vapour-deposition, sputtering or plasma-deposition.

The use of aluminium for the cover layer is attractive because of its low atomic number and a comparatively low X-ray absorption, whilst a foil provided with aluminium can be comparatively readily deformed, even when comparatively large deformations occur. An even lower absorption can be realized by using beryllium for one or both sealing layers; on the other hand, because of the small thickness use can also be made of elements having a higher atomic number.

A multiple layer thus formed can be suitably shaped by means of a simple operation. Because a stable shape can be imparted to an entrance window in accordance with the invention, an entrance screen is arranged directly on an inner side thereof in a preferred embodiment. The metal coating on the inner side can then be adapted to the requirements for the arrangement of the entrance screen thereon, and the outer layer can be adapted to other requirements, if any.

In a further preferred embodiment, the entrance window is bonded to a jacket portion of the tube so that the side face of the entrance window is also sealed from the ambient atmosphere. This can also be realized by interconnecting the shielding foils at that area. For the bonding use may notably be made of a thermocompression seal with, for example aluminium or lead as the sealing material. The foregoing is realized as described in European Patent Application EP-A-No. 201123.

An entrance window of a X-ray image intensifier tube notably comprises a carbon foil having a thickness of, for example from 0.25 to 0.75 mm, covered on both sides with an aluminium layer having a thickness of approximately 0.1 mm. Thus, an entrance window is obtained which exhibits, notably for comparatively soft X-rays, a transmission which is substantially higher than that of existing entrance windows. This benefits notably the quantum detection efficiency of the tube and offers, for the same patient dose, an image which contains more diagnostic information, or a lower patient dose for the same amount of diagnostic information.

BRIEF DESCRIPTION OF THE DRAWING

Some preferred embodiments in accordance with the invention will be described in detail hereinafter with reference to FIGS. 1 and 3.

DESCRIPTION OF THE PREFERRED EMBODIMENT

Figure 1:
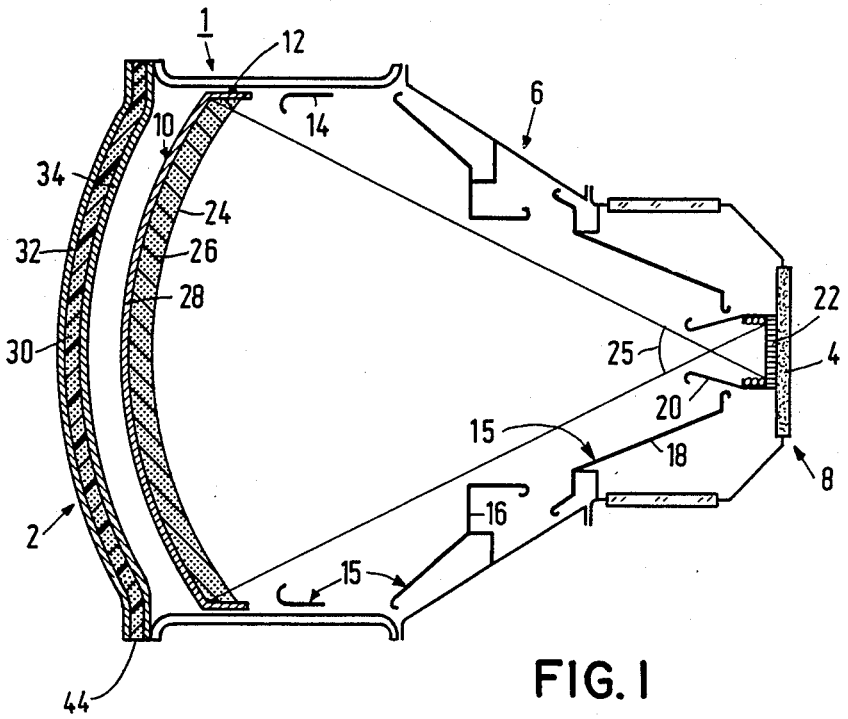

FIG. 1 of the drawing shows an X-ray image intensifier tube 1 having an entrance window 2 and an exit window 4 which constitute, in conjunction with a cylindrical jacket portion 6, an envelope 8 of the X-ray image intensifier tube 1. In the envelope an entrance screen 10 with a suspension 12 and a focus electrode 14 are arranged at an entrance side. At an exit side there are arranged electrodes 16, 18 and 20 which constitute, in conjunction with the electrode 14, an electrode system 15 for forming on an exit screen 22, an image of a beam of photo electrons 25 emerging from the photocathode 24 of the entrance screen. The photo electrons are released from the photocathode via a luminescent layer 26 which consists of, for example a layer of CsI vapour deposited on a carrier 28. In the present embodiment the entrance screen is arranged on a separate carrier to be mounted in the tube. However, for the invention it is irrelevant how the entrance screen is mounted in the tube. Because of the high degree of freedom as regards the shape and the high shape stability of the entrance screen it may be advantageous to arrange the entrance screen directly on the entrance window, so that a further gain can be realized as regards radiation efficiency and the length of the tube may be reduced.

Figure 2:
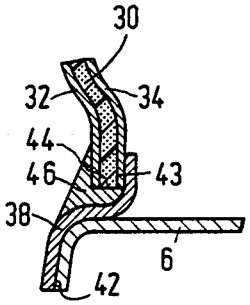

An entrance window in accordance with the invention comprises a carbon fibre reinforced plastics layer 30 having a thickness of, for example from 0.25 to 1.0 mm, an outer side of which is provided with a metal layer 32 which preferably consists of a layer of aluminium having a thickness of, for example from 0.1 to 0.25 mm, a similar metal layer 34 being provided on an inner side thereof. If desired in order to increase the X-ray transmission or for other reasons, one of the metal layers may also consist of a different metal, for example beryllium but also titanium or steel. Referring to FIG. 2, for bonding the entrance window 2 to the jacket portion 6 use is made of an auxiliary 38 which is connected to the jacket portion in a vaccumtight manner, for example by way of a seam 42, and which is connected to the entrance window by way of an aluminium seal 43 in a vacuumtight manner. For additional sealing and against possible gas leakage via a side face 44 of the plastics foil, this side face is embedded within a vacuumtight filling 46 which extends across an edge portion of the entrance window but which leaves exposed a part which is relevant for imaging. The use of aluminium for the metal layers for the entrance window and the metal plug not only offers the advantage of low X-ray absorption but also the advantage of suitable vacuumtightness, ease of working and the possibility of making suitably vacuumtight seals, as has already been stated. The bonding of aluminium to the carbon foil is not problematic either. Multiple layers with a carbon fibre reinforced carbon foil covered on both sides with an aluminium layer are commercially available and can be comparatively easily deformed to obtain the shape required for an entrance window.

What is claimed is:

1. An X-ray image intensifier tube (1) comprising an entrance window (2) and an exit window (4) which form part, together with a cylindrical jacket (6), of a vacuumtight envelope (8) which accommodates an entrance screen (10) with a luminescent layer (26) and a photocathode (24), a photo electron imaging electrode system (15) and an exit screen (22), characterized in that the entrance window (2) comprises a carbon fibre reinforced plastics foil covered with a metal layer (32, 34).

2. An X-ray image intensifier tube as claimed in claim 1, characterized in that the plastics foil is covered with a metal layer (32, 34) on both sides.

3. An X-ray image intensifier tube as claimed in claim 1 or 2, characterized in that different elements are used for the metal cover layers on the inner side and the outer side.

4. An X-ray image intensifier tube as claimed in claim 1 or 2, characterized in that the entrance screen is arranged directly on an inner side of the entrance window.

5. An X-ray image intensifier tube as claimed in claim 1 or 2, characterized in that the metal layer consists of aluminium at least on the inner side.

6. An X-ray image intensifier tube as claimed in claim 1 or 2, characterized in that the entrance window is connected to the cylindrical jacket portion by way of an intermediate ring (38).

7. An X-ray image intensifier tube as claimed in claim 6, characterized in that a steel intermediate ring (38) is connected to the cylindrical jacket (6) via a welded seam (42) and to the entrance window via a thermocompression seal (43).

8. An X-ray image intensifier tube as claimed in claim 1 or 2, characterized in that the entrance window is connected to the cylindrical jacket portion so that a side face of the plastics foil is completely covered with a vacuumtight material (46).

* * * * *